United States Patent [19]

Nohmura et al.

[11] 4,060,119

[45] Nov. 29, 1977

[54] SHIELDING TENT

[75] Inventors: Ryotaro Nohmura, Suita; Eiji Tazaki, Mitaka; Akio Sato, Kodaira, all of Japan

[73] Assignee: Taiyo Kogyo Company Limited, Osaka, Japan

[21] Appl. No.: 683,582

[22] Filed: May 6, 1976

[30] Foreign Application Priority Data

Sept. 6, 1975 Japan ..... 50-108192

[51] Int. Cl.[2] ..... E06B 9/17

[52] U.S. Cl. ..... 160/266; 160/22; 160/88

[58] Field of Search ..... 160/20, 21, 29, 88, 160/128, 133, 183, 238, 239, 240, 266, 274, 275, 290; 47/40

[56] References Cited

U.S. PATENT DOCUMENTS

| | | | |
|---|---|---|---|
| 962,176 | 6/1910 | Templeton | 160/88 |
| 1,400,567 | 12/1921 | Mulford | 160/275 |
| 1,823,290 | 9/1931 | Prawalsky | 160/275 |
| 2,093,314 | 9/1937 | MacDonald | 160/183 |
| 2,323,612 | 7/1943 | Lombardi et al. | 160/133 |

*Primary Examiner*—Peter M. Caun

*Attorney, Agent, or Firm*—John C. Smith, Jr.

[57] ABSTRACT

A shielding tent wherein a frame is fixed above a window or the like, a winding device for winding up a canvas or window screen is removably fitted to this frame, sliding frames each having a groove guiding and engaging the canvas or window screen are rotatably borne at the upper ends on both ends of the frame, a bottom member removably fitted in the horizontal direction below the window is rotatably connected at the outer end with the lower end of the sliding frame which is inclined outward.

As required, side plates are rotatably pivoted to the sliding frames and the frame of the side plates is removably fitted to the bottom member so that the structure may be foldable and may have a pot or the like mounted on it.

11 Claims, 11 Drawing Figures

SHIELDING TENT

This invention relates to a shielding tent provided with a bottom member. The conventional shielding tent used as such acted as a shelter from the sun in front of a store or the like and was fixed or was movable with a frame for folding a shield made of a canvas or the like.

However, such shielding tent was too large to fit to a window of a house or mansion, was too troublesome for an amateur to fit and was likely to be blown off by a strong wind even if it was fitted.

An object of the present invention is to provide a shielding tent which eliminates the above mentioned defects, is easy to fit, is attractive in the appearance and has a fitting strength.

Another object of the present invention is to provide a shielding tent which can be simply folded in the case of such very strong wind as a tyhoon.

Figure 5:
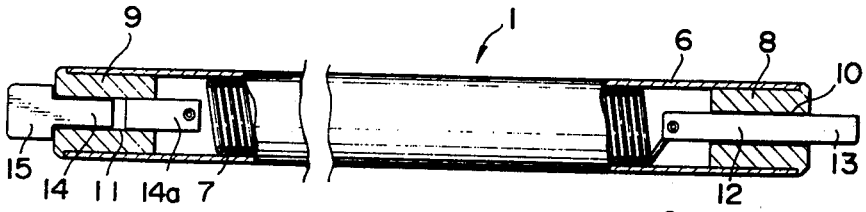
FIG. 5 is a partly sectioned plan view of a winding device.
Figure 6:
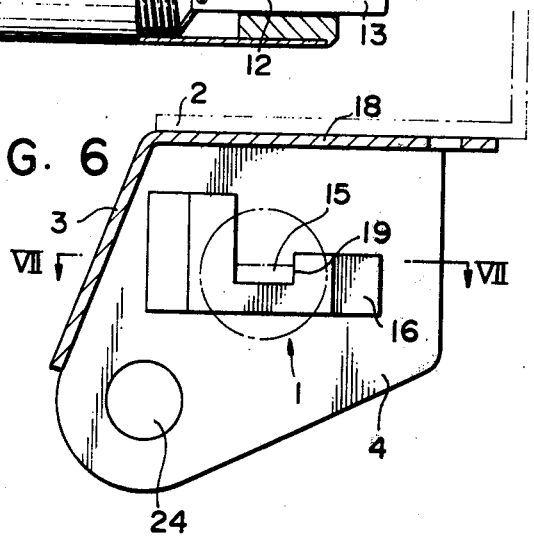
FIG. 6 is a side view showing a side wall of a frame for holding the winding device.
Figure 7:
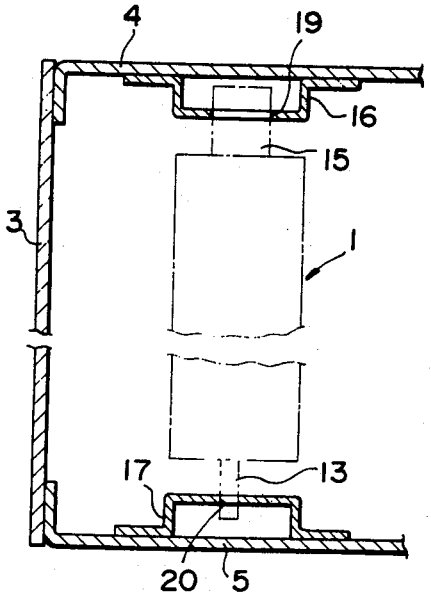
FIG. 7 is a sectioned view on line VII—VII in FIG. 6 in case the winding device is fitted to the frame.

A winding device 1 of the present invention is to be held by side walls 4 and 5 of a frame 3 fitted above a window or the like with an angle 2 and its particulars are shown in FIGS. 5 to 7.

The winding device 1 consists of a hollow cylinder 6 and contains a coil spring 7 in it. Plugs 8 and 9 having respectively holes 10 and 11 in the centers are fixed to both ends of the hollow cylinder 6. A pin 12 is rotatably passed through the hole 10 in the plug 8, has a flat part 13 at the outer end and has a hole for engaging the above mentioned coil spring 7 at one end formed at the inner end.

On the other hand, a pin 14 projecting out of the cylinder 6 is also inserted in the hole 11 in the plug 9 but is rotatably held at the inner end in the hole 11 without projecting into the cylinder 6.

The pin 14 has also a flat part 15 at the outer end so that, when the coil spring 7 is not energized, the flat parts 13 and 15 may be directed in the directions at right angles with each other.

A pin 14*a* is fixed in the hole 11 as directed into the cylinder 6 out of the hole 11 and has a hole for engaging the coil spring 7 at the other end formed at the inner end.

In order to fit such winding device 1 to the side walls 4 and 5 of the frame 3, fittings 16 and 17 are fixed in the respectively corresponding positions and at intervals below a top wall 18 of the frame 3.

The fittings 16 and 17 are provided with respectively upward opened cuts 19 and 20. The cut 19 in the fitting 16 is horizontally long and its width substantially corresponds to the width of the flat part 15. On the other hand, the cut 20 in the fitting 17 is vertically long and its width substantially corresponds to the thickness of the flat part 13.

In the case of holding the winding device 1 with the fittings 16 and 17, if the flat parts 13 and 15 of the winding device 1 are inserted as directed at right angles with each other into the respective cuts 19 and 20 from above the fittings 16 and 17, the winding device will be simply fitted. According to this fitting mechanism, the pins 12 and 14 on both sides will be supported without being covered from above the cuts and, even if the cylinder 6 rotates, the pins will not rotate together or will not be removed. In removing the winding device, the above mentioned process may be reversed.

Figure 1:
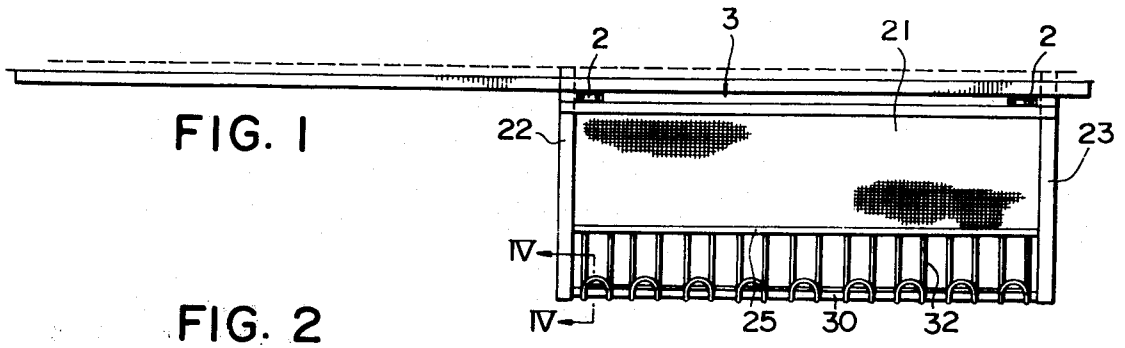
FIG. 1 is a plan view of shielding tent according to the present invention.
Figure 2:
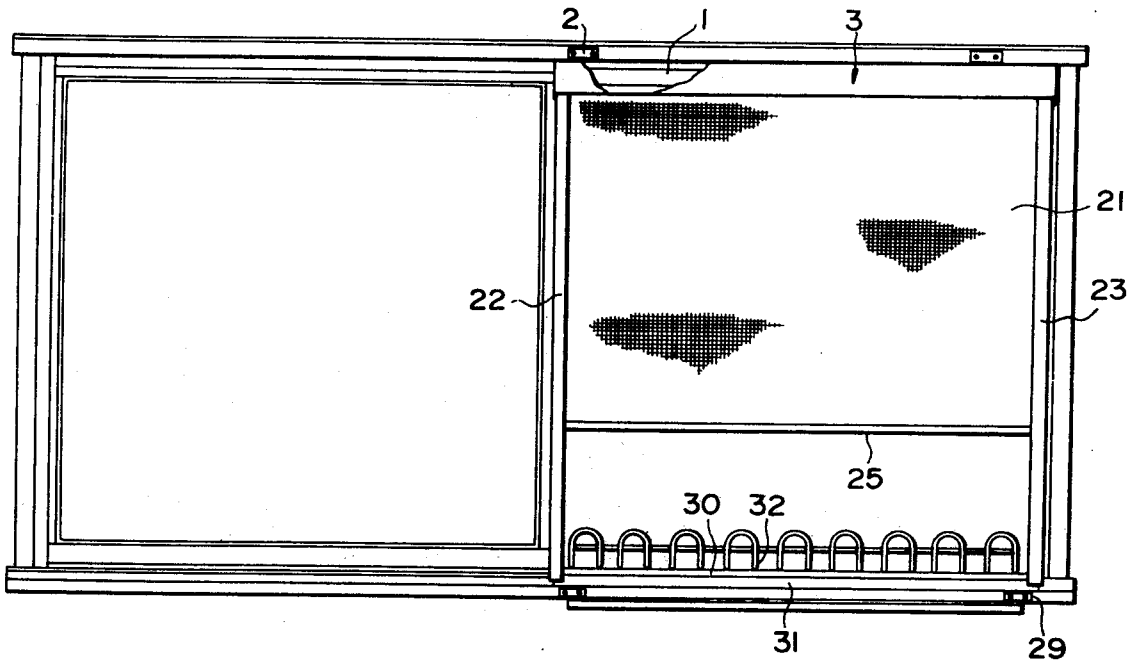
FIG. 2 is a partly sectioned elevation of FIG. 1.
Figure 3:
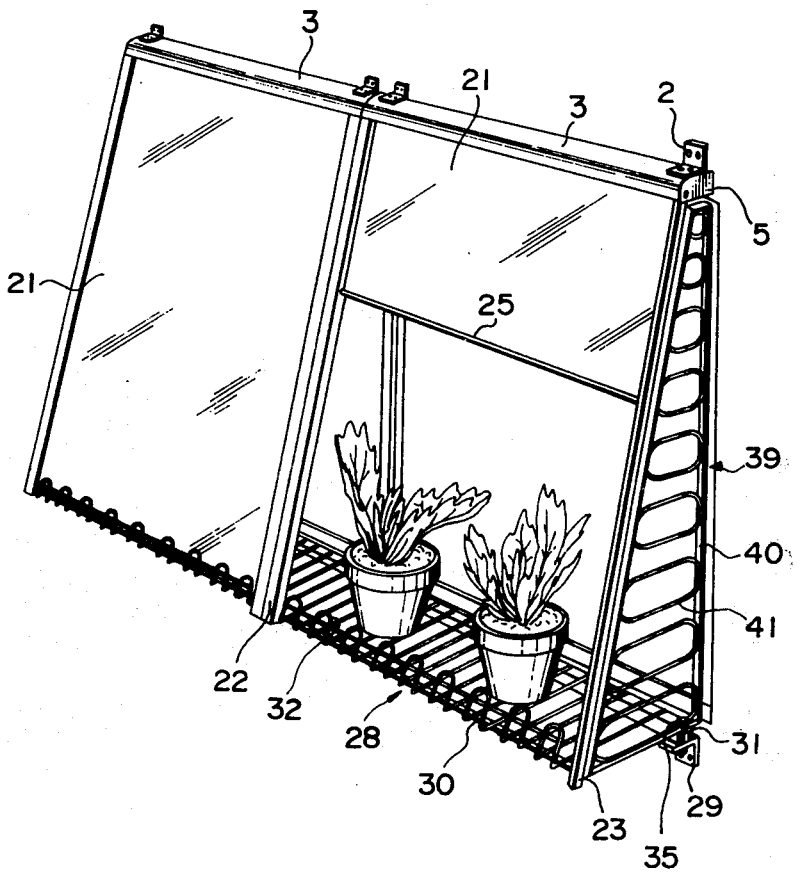
FIG. 3 is a perspective view of FIGS. 1 and 2 as fitted to both sides of a window.

A canvas or window screen 21 may be fixed at one end, for example, with screws or the like to proper parts on the outer periphery of the cylinder 6 and, at the same time, a hanging shaft 25 which is a little longer than the width of the canvas may be fixed to the other end edge of the canvas 21 (See FIGS. 1 to 3). Thus, the winding device 1 can be fitted and removed even by an amateur so simply that any desired canvas can be selected and fitted.

Therefore, if the canvas or window screen 21 is pulled down by holding the lower end part with the winding device, it will be able to be stretched and, if it is released, it will be able to be unwound and pulled up to the original position by the returning force of the coil spring 22 and 23 are sliding frames fixed at the upper ends in holes 24 made at the lower ends of the side walls 4 and 5 of the above mentioned frame 3 with supporting shafts or bolts 47, having on the insides grooves 26 through which the hanging shaft 25 secured to the lower end of the window screen or the like 21 slides up and down at both ends. A plurality of hanging holes 27 are made in the groove 26 so that the hanging shaft 25 may be engaged at both ends in any desired position. (See FIG. 9).

Figure 4B:
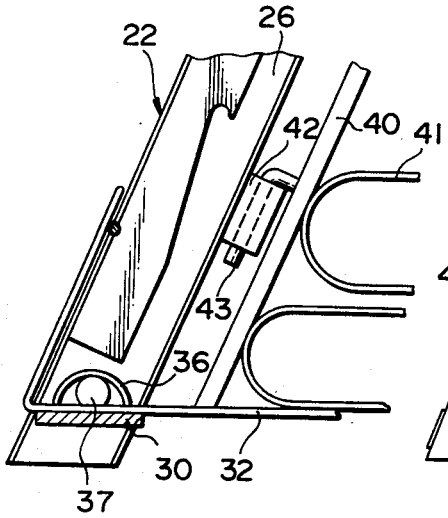
FIG. 4B is a sectioned view on line IV—IV in FIG. 1.
Figure 4A:
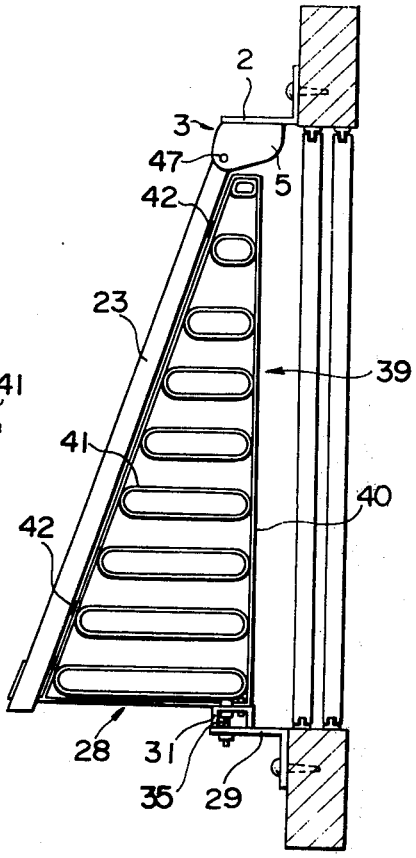
FIG. 4A is a side view of FIG. 1.
Figure 8:
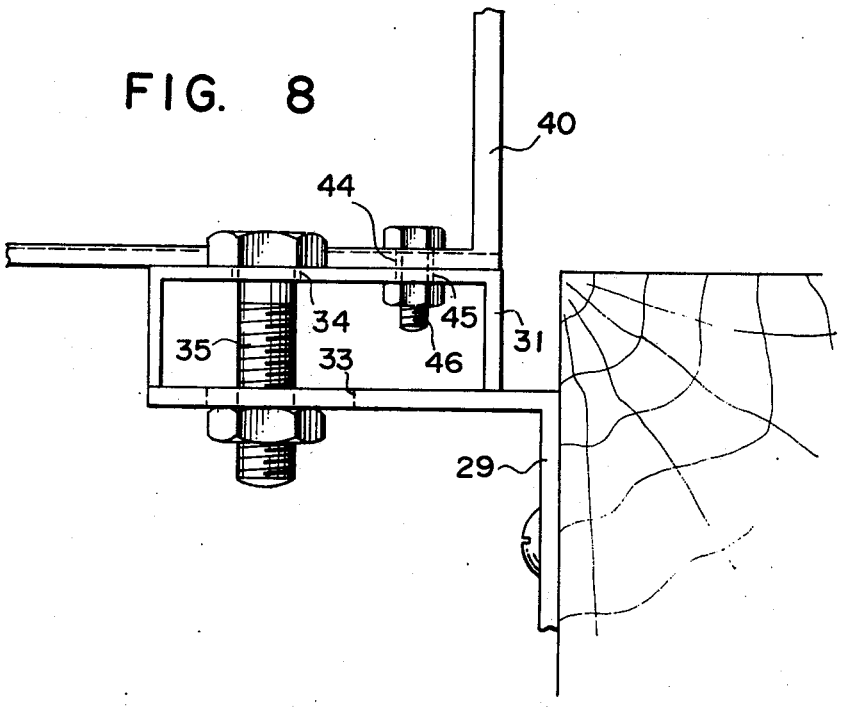
FIG. 8 is a side view showing a bottom member as fitted below a window.
Figure 10:
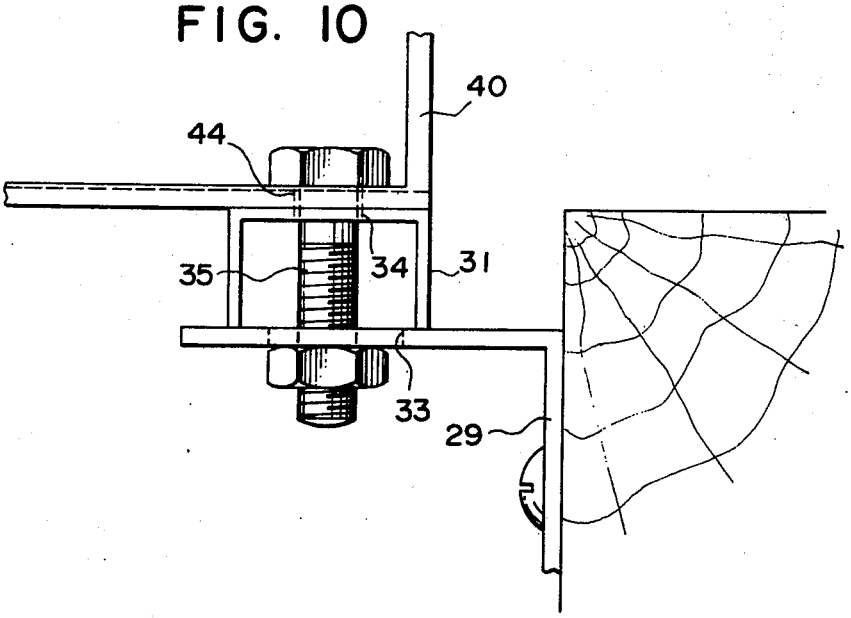
FIG. 10 is a side view showing another embodiment of FIG. 8.

As shown in FIGS. 4A, 8 and 10, the bottom member 28 is formed of a flat plate 30 and a supporting plate 31 of an inverted U-shaped cross-section parallel with each other and many lattices 32 bridging the flat plate 30 and supporting plate 31. It is needless to say that the lattice 32 is not limited to be of such form as is illustrated but can be made to be of any form. Also a pallet which can be fixed on the bottom member 28 may be provided. In order to fit such bottom member 28 below a window or the like, an angle 29 is first fixed outside the window frame with screws or the like.

Slots 33 are made in the angle 29 and holes 34 are made in the supporting plate 31 of the inverted U-shaped cross-section. The slot 33 and hole 34 are in the positions substantially corresponding to each other. If bolts 35 are fastened through these holes 33 and 34, the bottom member 28 will be fitted as projected horizontally below the window.

The above mentioned sliding frames 22 and 23 are connected with the bottom member 28 as follows as illustrated in FIG. 4B. Semi-cylindrical members 36 are secured to both ends of the flat plate 30 of the horizontally projecting bottom member 28. On the other hand, projections 37 projecting inward with each other in the positions corresponding to the members 36 on the sides facing the sliding frames 22 and 23 are provided on the respective sliding frames 22 and 23 so that the sliding frames 22 and 23 may be connected with the bottom member 28 with a fixed angle by the fitting of the projection 37 with the semi-cylindrical member 36.

In the present invention, as required, it is possible to provide side plates 38 and 39 between the sliding frame and window. The side plates 38 and 39 consist of a frame 40 and lattices 41 provided within this frame 40. The same as the above mentioned bottom member 28, the design of the lattices 41 can be freely modified within the frame 40. Further, the side plates are not limited to be lattices but may be blind plates. However, from the standpoint of the ventilation and appearance, lattices of a proper design are preferable.

In fitting the side plates 38 and 39, as particularly shown in FIG. 4B, cylindrical engaging parts 42 are fitted at intervals in the vertical direction to the sliding frames 22 and 23, on the other hand, hooks 43 are provided in the corresponding positions of the frame 40 and are engaged with the respective engaging parts 42 and, as shown in FIG. 8, separate holes 45 are made in the supporting plate 31, holes 44 are made in the positions of the frame 40 corresponding to these holes 45 and bolts 46 are fastened through the holes 45 and 44.

As described above, as the sliding frames are fitted at the lower ends to the flat plate at the outer ends of the bottom member, the bottom member will be held securely, the formation will be simple and further a shielding tent covering the entire window will be obtained. Further, as the wind blowing up from below is induced into the room by the inclined shielding tent (including the window screen), it will be cool. As the bottom member is provided, a pot or the like will be able to be mounted on it and the appearance will be fine. When the window is opened, the room will be able to be felt to be larger.

Figure 9:
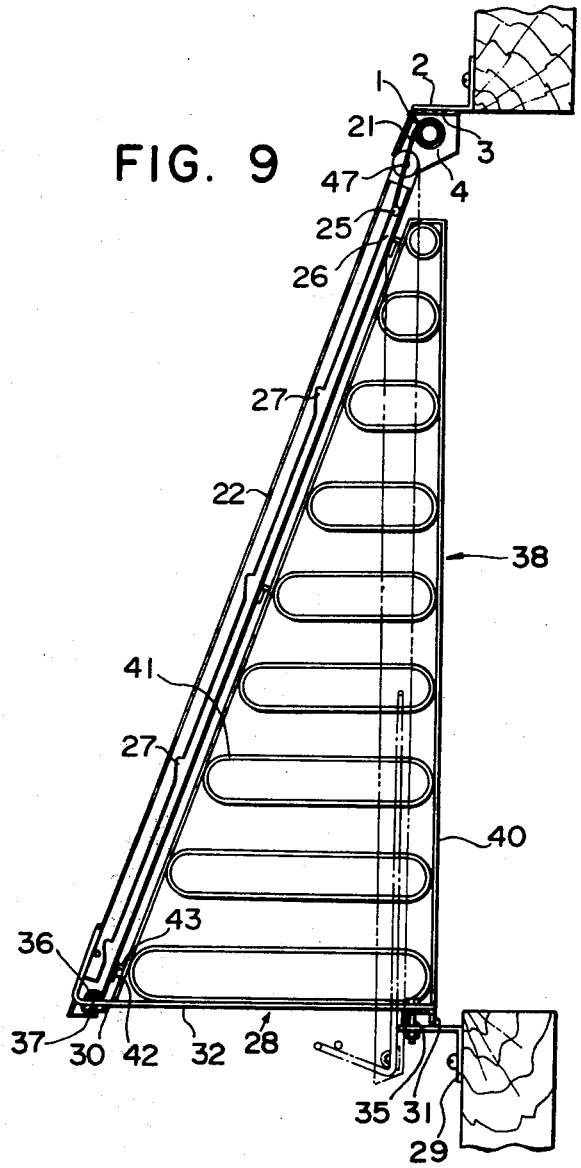
FIG. 9 is a sectioned side view showing the shielding tent as fitted and as folded.

FIG. 9 is a vertically sectioned side view showing a shielding tent of the present invention as folded. The sliding frames 22 and 23 are rotatably fitted at the upper ends by a supporting shaft 47 to the holes 24 in the side walls 4 and 5 of the frame 3 holding the winding device 1 and are held, for example, with split pins or the like so that the supporting shaft 47 may not be pulled out. On the other hand, as the sliding frames are fitted at the lower ends to the bottom member 28 by the fitting of the projections 37 with the semi-cylindrical members 36 as described above, the bottom member 28 will be rotatable with respect to the sliding frames 22 and 23. The supporting plate 31 of the inverted U-shaped cross-section on the window side of the bottom member 28 is removably fixed to the angle 29 secured to the window frame side, for example, with the bolts 35. In case the side plates 38 and 39 are provided, they will be rotatably borne respectively on the sliding frames 22 and 23 by the fitting of the hooks 43 with the engaging members 42. In case the side plates 38 and 39 are provided, in order to simplify the folding, as in FIG. 10, the holes 44 in the frame 40 of the side plates 38 and 39 will be aligned with the holes 34 in the supporting plate 31 and the slots 33 in the angle 29 and the side plates, bottom member and angle will be secured, for example, by passing the bolts 35 through the holes 44, 34 and 33. Therefore, as required, when the bolts 35 are removed, the bottom member 28 is brought down on the side of the sliding frames 22 and 23 around the projection 37 as a center and further the sliding frames are pulled on the lower sides toward the window frame around the supporting shaft 47 as a center and are fixed, as shown by the broken lines in FIG. 9, the shielding tent will be able to be folded. In such case, when there are the side plates 38 and 39, the tent will be folded on the side of the sliding frames 22 and 23 around the hook 43 as a center.

Thus, the entire window can be used as a close shield or a screen door and can be protected from a strong wind.

As explained in detail in the above, according to the present invention, there are advantages that the winding device can be changed so simply that any canvas favorable to the seasons can be used, that, as the bottom member is fitted to the sliding frames, the strength of the sliding frames will increase, that, as the bottom member is provided, a pot or the like will be able to mounted on it, the appearance will be fine and, when the window is opened, the room will be felt to be larger, that, when the sliding frames, bottom member and side plates fitted as required are borne, the sliding frames will be able to be folded and therefore a window screen will be provided instead of the canvas in this state so that, when it is pulled, it may be packed and carried as folded, may require a small space and may be convenient to handle and that it can be utilized as a screen door.

What is claimed is:

1. A foldable shielding tent for a window comprising in combination:

a. mounting means adapted to be secured to a structure adjacent the top of the window;
b. elongated winding means;
c. means releasably securing said winding means to said mounting means;
d. means biasing said winding means for rotation in one direction;
e. web material secured at one end thereof to said winding means for coiling about said winding means when rotated in said one direction;
f. a pair of elongated sliding frame members;
g. means pivotally securing one end of each of said sliding frame members to said mounting means adjacent opposite ends of said elongated winding means such that said sliding frame members extend in a generally downward direction;
h. means on at least one of said sliding frame members for retaining the free end of said web material at at least one location along the length of said sliding frame member;
i. a bottom member;
j. means pivotally securing one side of said bottom member to said sliding frame members adjacent their lower ends; such that said bottom member may be pivoted upwardly between the sliding frame members and the window; and
k. means for releasably securing the side of said bottom member opposite said one side to the structure adjacent the bottom of the window;
l. whereby, when said shielding tent is unfolded, said sliding frame members extend angularly outwardly from the top of the window when the lower ends of said sliding frame members are supported by said bottom member at a predetermined distance from the bottom of said window, and when said shielding tent is folded, said sliding frame members extend parallel to the window when said bottom member is released from the structure and pivoted upwardly parallel to said sliding frame members; and m. whereby different winding means supporting different web materials may be exchanged in said shielding tent.

2. A foldable shielding tent as defined in claim 1 further comprising:

a. a pair of side members;

b. means pivotally securing each of said side members along one of said sliding frame members; and c. means for releasably securing said side members to said bottom member;

d. whereby when said shielding tent is unfolded said side members extend from said sliding frame members respectively to the sides of the window, and when said shielding tent is folded said side members are released from said bottom member and pivoted inwardly parallel to said sliding frame members.

3. A foldable shielding tent as defined in claim 1 further comprising a reinforcing rod mounted on the free end of said web material and extending between said sliding frame members, each of said sliding frame members comprising means defining a channel including a plurality of spaced retaining means whereby the opposite ends of said reinforcing rod may be retained at a plurality of different positions along the lengths of said sliding frame members.

4. A foldable shielding tent as defined in claim 1 wherein said elongated winding means comprises a hollow cylinder, a coil spring in said cylinder, plugs secured at opposite ends of said cylinder each said plug having a hole passing through the center thereof, a first pin passing rotatably through said hole in one of said plugs, the inner end of said first pin being secured to one end of said coil spring and the outer end of said first pin being flat, a second pin inserted rotatably in said hole in the other of said plugs and having a flat part at the outer end thereof, and a third pin fixed at one end thereof adjacent to said second pin in said hole in the other of said plugs and extending inwardly, the inner end of said second pin being secured to the other end of said coil spring.

5. A foldable shielding tent as defined in claim 4 wherein said means for releasably securing said winding means to said mounting means includes means defining a vertical slot opening upwardly for receiving one of said first and second pins at one end of said winding means and means defining a horizontal slot opening upwardly for receiving the other of said first and second pins at the opposite end of said winding means.

6. A foldable shielding tent as defined in claim 1 wherein said web material is a canvas.

7. A foldable shielding tent as defined in claim 1 wherein said web material is a window screen.

8. A foldable shielding tent as defined in claim 1 wherein said bottom member comprises two supporting plates and lattices bridging said supporting plates.

9. A foldable shielding tent as defined in claim 1 wherein said means for releasably securing the side of said bottom member to the structure adjacent the bottom of the window comprises two angular members each having a slot therein, said bottom member including holes aligned with said slots, and bolt means passing through said holes and slots.

10. A foldable shielding tent as defined in claim 1 wherein said means pivotally securing one side of said bottom member to said sliding frame members comprises a pair of semi-cylindrical members fixed to said bottom member and projections on said sliding frame members which are fitted into said semi-cylindrical members.

11. A foldable shielding tent as defined in claim 1 comprising a pair of said elongated winding means, the web material secured to one of said winding means being a canvas and the web material secured to the other of said winding means being a window screen, said pair of winding means being interchangeable on said means for releasably securing said winding means to said mounting means.

* * * * *